United States Patent [19]

Cunningham

[11] 4,227,672

[45] Oct. 14, 1980

[54] BEAM FORM AND SHORING STRUCTURE

[76] Inventor: Arthur L. Cunningham, 6055 Windemere Way, Riverside, Calif. 92506

[21] Appl. No.: 24,014

[22] Filed: Mar. 26, 1979

[51] Int. Cl.[3] ..... E04G 11/40

[52] U.S. Cl. ..... 249/28; 249/24

[58] Field of Search ..... 249/24, 28–30; 264/33, 34

[56] References Cited

U.S. PATENT DOCUMENTS

| | | | |
|---|---|---|---|
| 1,958,933 | 5/1934 | Williams | 249/28 X |
| 2,058,268 | 10/1936 | Stanley | 249/24 |
| 3,037,259 | 6/1962 | Dave | 264/33 X |

*Primary Examiner*—Thomas P. Pavelko

*Attorney, Agent, or Firm*—Fulwider, Patton, Rieber, Lee & Utecht

[57] ABSTRACT

A beam form and shoring structure capable of precise alignment with adjacent vertical columns of a building structure to enable pouring of a beam between the columns. The beam form is supported along its length by a plurality of shoring frames which are retractable so that the beam form can be moved for reuse at the next pouring station. Each of the shoring frames includes side portions for supporting an adjacent slab form so that a floor slab can be poured at the time the beam is poured, the side portions being such that they can be lowered to strip the slab form from the freshly poured slab to enable the slab form to be moved for reuse at the next slab pouring station.

10 Claims, 8 Drawing Figures

40
10
22
74
40
28
10
28
24
84
84
24
28
28
40
14
74
3
16
16
3
12
12
18
14
16
16
74
14
14
2
22
40
28
28
84
84
24
24
28
40
10
28
10
40
74
74
2

BEAM FORM AND SHORING STRUCTURE

BACKGROUND OF THE INVENTION

1. Field of the Invention

The present invention relates to beam form and shoring structures, and particularly to beam form and shoring structures adapted to be moved as an integral unit from one concrete pouring station to the next.

2. Description of the Prior Art

In constructing floor slabs and beams for high rise buildings, parking garages, or the like, forming structures are required to support each concrete slab and beam as it is poured and during its curing period. For example, in constructing beam forms in a rectangle or bay defined by four columns, one method of the prior art involves piecemeal, in-place construction of the forms, using steel sections, scaffolding, plywood sheeting and the like. Once the concrete has been poured and cured, the whole structure is taken apart and as much of the structure as possible is salvaged for assembly at the next concrete pouring station. This involves an inordinate amount of manual labor and a considerable wastage of building materials.

To avoid the high material and labor costs of the process just described, other methods of the prior art utilize single, monolithic or integral forming structures which can be placed in position to both form and support the concrete structures during curing. Such forming structures can be removed and relocated or "flown" to the next concrete pouring station by utilizing cranes, or they can be moved internally on dollies, thus eliminating the need for cranes. This latter method of using dollies is especially efficient and can save the contractor large sums of money when forming parking garages where the equipment can be rolled to its new position using the ramps formed from earlier pours. With either method the form is lowered and thereby stripped from the poured structure. If it is to be flown, it is moved outwardly to a point where the hoisting cables are attached. It is then moved laterally to an adjacent bay, or hoisted upwardly for use at the next higher floor level. If dollies are used instead, the stripped form is lowered onto the dollies and transported to the next pour station.

Despite the great cost savings realized through use of such an integral form, it has been found difficult to precisely align such a form between the centerlines of the associated columns. A great deal of cutting and fitting and tailoring is encountered in exactly mating the beam form with the columns and, where adjacent floor slabs are to be formed, with the associated floor slab forms.

SUMMARY OF THE INVENTION

According to the present invention, a beam form and shoring structure is provided which includes an elongated beam form having a plurality of shoring frames spaced apart along its length. Each of the frames includes an upper portion which is pivotally carried by the beam form so that the shoring frame can be moved between a vertical supporting position and a generally horizontal moving position for flying or other transportation.

Each shoring frame also includes side portions having vertically extensible and retractable slab form supports so that a slab form can be supported between a pair of the spaced apart beam forms, thereby enabling pouring of an adjacent slab contemporaneously with pouring of the beam. The shoring frames include jacks operative to adjust the vertical position of the shoring frames so that the associated beam form is precisely located at the desired height. Each frame further includes adjustment means operative upon the frame upper portion to laterally adjust the beam form so that it is in precise alignment with the centerlines of the adjacent columns. The slab form supports further may include rollers for supporting the slab form. Such rollers are useful in flying the slab form to a new location. The shoring frame not only aligns the beam with the column, but also safely carries the entire weight of the concrete.

With this arrangement, once the beam and slab have been poured and cured, the slab form supports can be retracted to strip away the slab form from the freshly poured floor slab, at which point the shoring or other supports for the slab form are retracted, enabling the slab form to be moved upon the rollers of the shoring frame into position where the slab form can be flown to the next pouring station, or lowered onto dollies, if that is the preferred form of transportation. The pivotable mounting of the shoring frames upon the beam form allows the shoring frames to be retracted to their moving positions once the beam form has been dropped and stripped away from the freshly poured beam, thereby enabling the beam form to be moved to the next beam pouring station.

Other objects and features of the invention will become apparent from consideration of the following description taken in connection with the accompanying drawings.

DESCRIPTION OF THE PREFERRED EMBODIMENT

Figure 1:
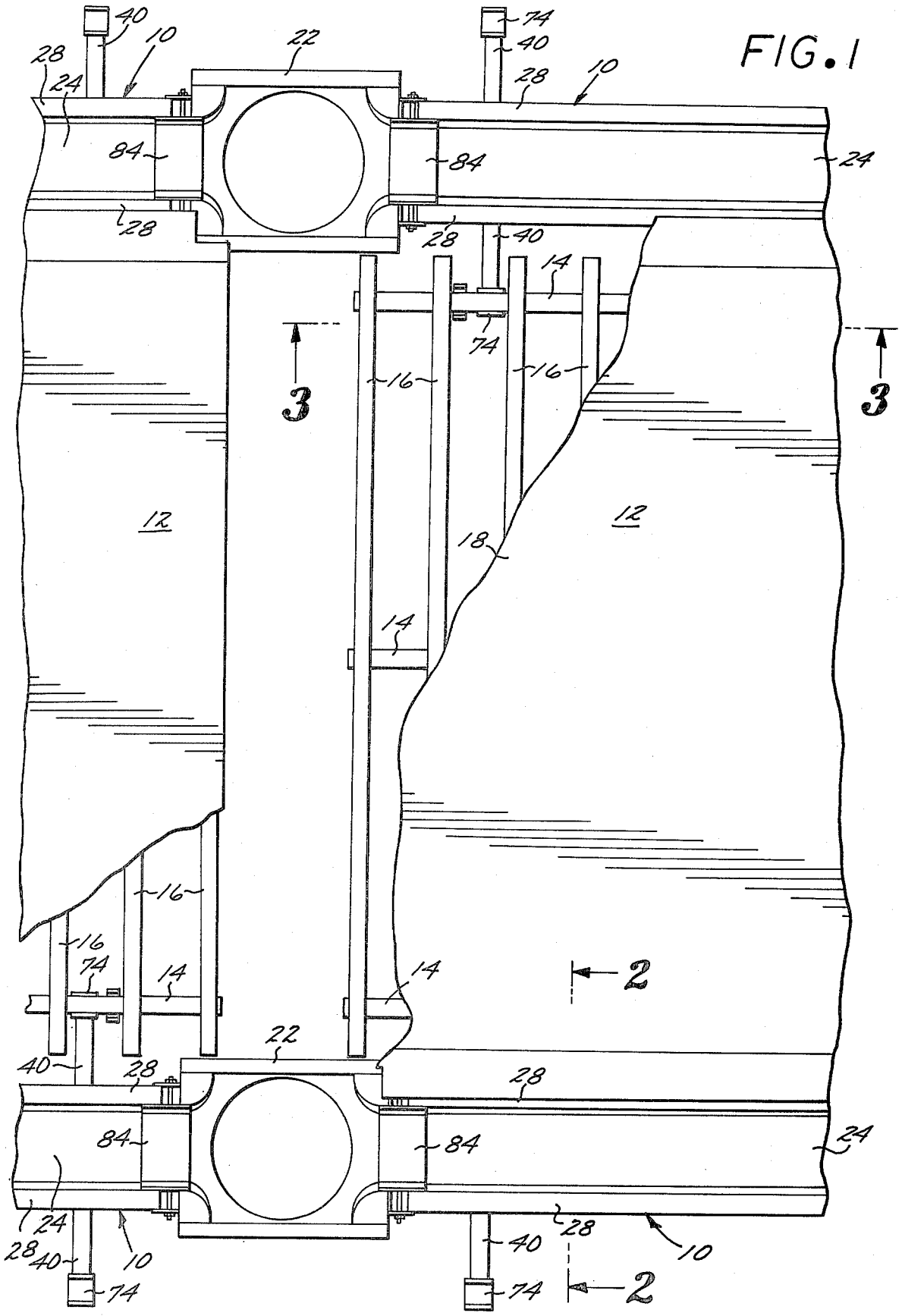
FIG. 1 is a partial plan view of portions of several of the present beam form and shoring structures located adjacent a pair of vertical columns of a building structure.
Figure 2:
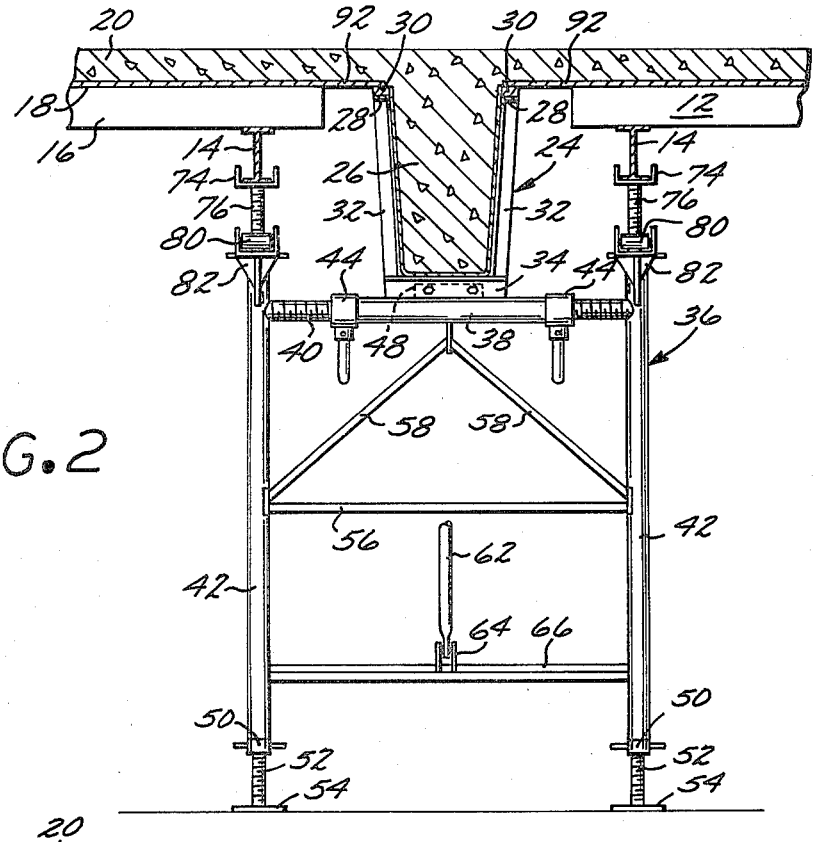
FIG. 2 is an enlarged view taken along line 2—2 of FIG. 1.
Figure 3:
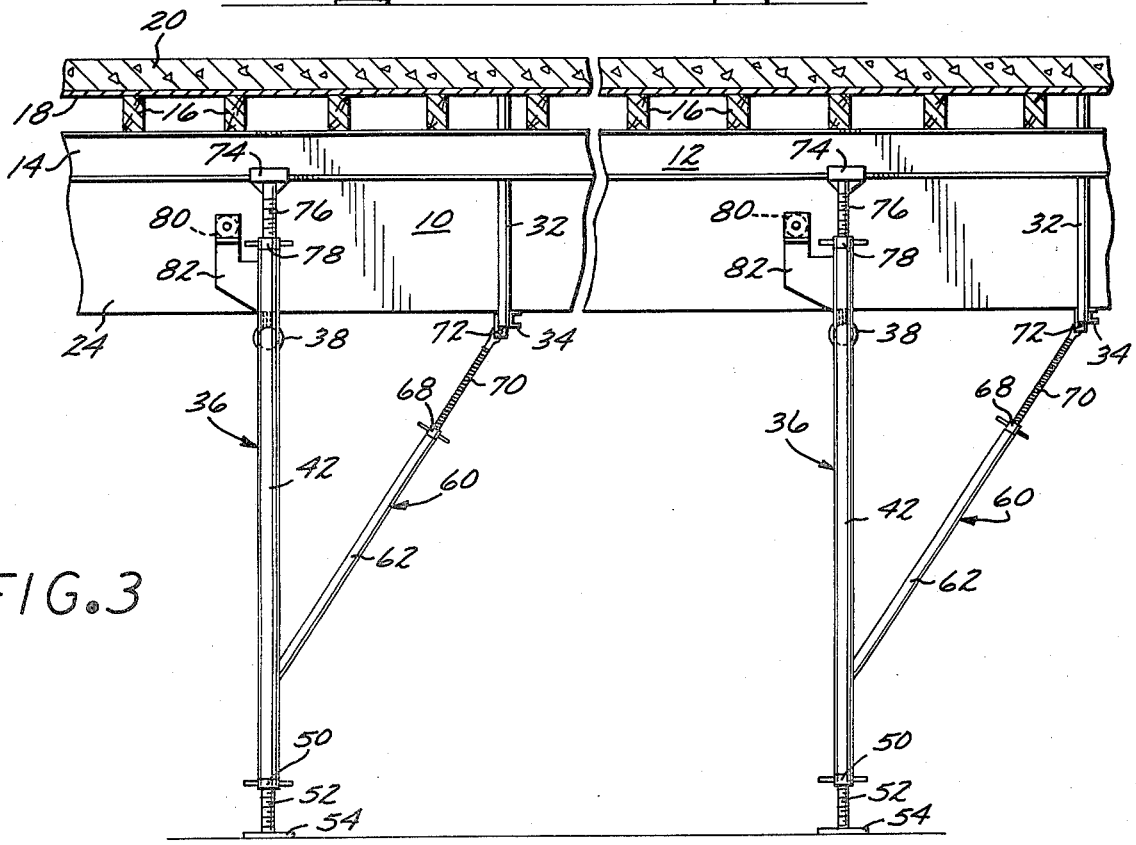
FIG. 3 is an enlarged view taken along line 3—3 of FIG. 1.

Referring now to the drawings, and particularly to FIGS. 1–3, there is illustrated a beam form and shoring structure 10 adapted for use in building construction to form a beam between a pair of vertical columns, while also locating and supporting one or more slab forms 12. The particular application illustrated and described in the present disclosure is merely exemplary since the size, location, and general arrangement of beams and slabs in various building applications can and do vary greatly.

The present structure 10 has been found to work uniquely well in multi-story parking structures in which the beams are typically quite long, usually about 60 to 65 feet. The beams provide large open spans for parking and the columns supporting the beams may be already poured at the time that the beams and associated floor slabs are poured, or the column can be poured at the same time as the beams and slabs, as will be apparent. In the drawings, only a pair of columns and a part of one of the slab forms 12 are illustrated, for brevity.

A typical slab form 12 comprises three elongated, laterally spaced-apart I-beams 14 which underlie and support a plurality of transverse, longitudinally spaced-apart joists 16. A wooden deck 18, made of plywood or the like, overlies and is supported by the joists 16, the deck 18 being the surface onto which the floor slab 20 is poured, as seen in FIGS. 2 and 3.

The beams 14 and joists are preferably made of aluminum for light weight, but the particular structure of the slab form 12 may vary greatly, depending upon the available materials, the span involved, and the like. Whatever its particular makeup, however, preferably the slab form 12 includes the pair of outwardly located beams 14 or their equivalent since these beams 14 provide a convenient means by which the present structure 10 can support one side of the form 12.

As seen in FIG. 1, a pair of the present structures 10 are located on either side of a slab form 12 to support the form during pouring of the slab 20. It is common where the slab 20 spans a considerable distance to provide additional supports in the form of center post shores (not shown) disposed beneath the center beam 14.

Figure 7:
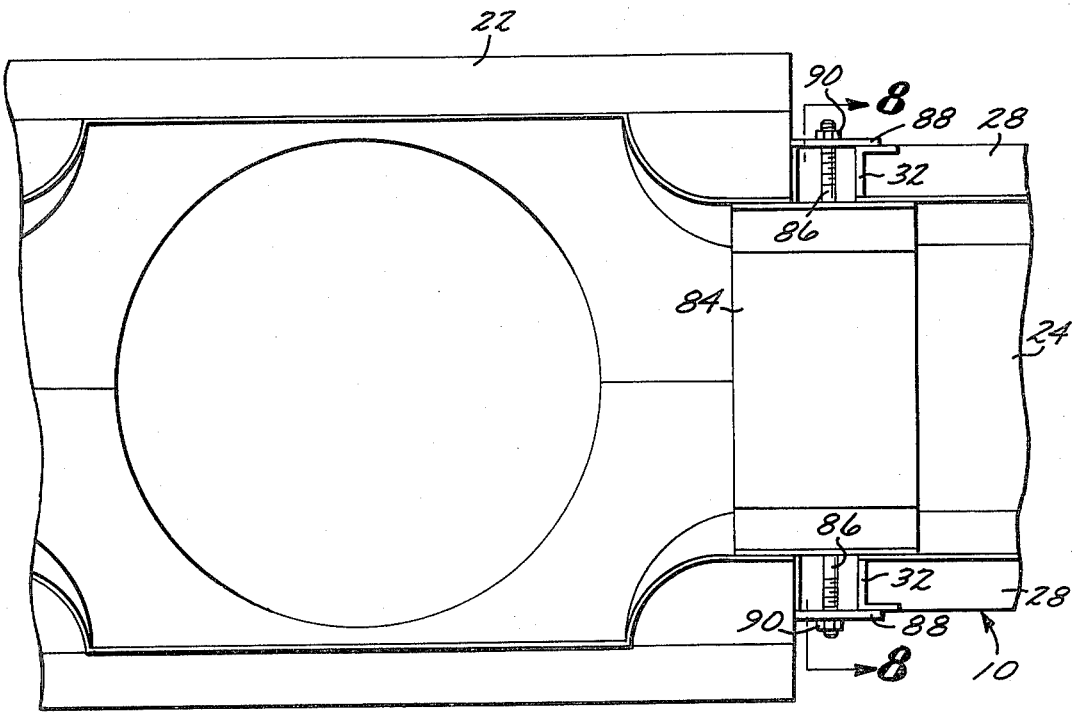
FIG. 7 is a partial, enlarged top plan view of one end of the present beam form and shoring structure, particularly illustrating the junction between one end of the beam form and an adjacent column.
Figure 8:
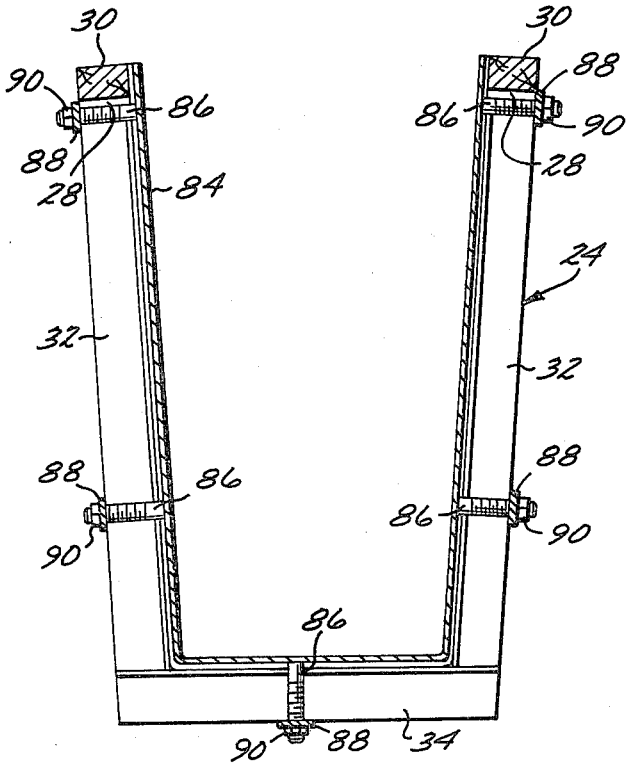
FIG. 8 is a view taken along the line 8—8 of FIG. 7, showing the filler piece which forms the transition from the beam to the column.

FIGS. 1 and 7 generally illustrate a pair of column forms 22 which, depending upon the style of construction, may be viewed either as surmounting, respectively, the tops of already poured columns (not shown), or constituting the upper portions of vertically elongated forms (not shown) within which the columns can be poured at the time the beams and floor slabs are poured. The manner of forming and pouring the individual columns does not form a part of the present invention.

Each of the beam form and shoring structures 10 comprises an elongated, upwardly open beam form 24 having a bottom, and upwardly divergent sides providing a draft to facilitate stripping of the beam form 24 away from the poured beam 26, as best seen in FIG. 2. The beam form 24 is preferably made of a formed steel section capped at its upper side edges by a pair of longitudinal angles 28 welded or otherwise secured in position. A pair of lengths 30 of wood are attached atop the angles 28 and constitute nailers 30, as will be seen.

At longitudinally spaced intervals, and at the ends, the beam form 24 is strengthened against deflection under the load of the poured concrete by vertically disposed side channels 32 which are joined together by a bottom channel 34 welded to the underside of the beam form 24. Typically, the end ones of the channels 32 and 34 are provided with mounting openings so that the channels can be secured to similar channels of another beam form 24 for convenient fabrication of long spans, the span length being made up of a predetermined number of the beam forms 24 joined together in abutting relation, as will be apparent.

Heretofore, it has been difficult to properly locate beam forms such as the forms 24 in exact alignment with the centerlines of the columns defined by the column forms 22, and at the exact height to place the nailers 30 in the general horizontal plane of the adjacent decks 18 of the slab forms 12. As previously indicated, prior art systems require excessive time and labor to build the connections between the beam forms and the columns they are to span.

According to the present invention, a plurality of shoring frames 36 are spaced apart along the length of the associated beam form 24, and also at the ends of the form 24. Each frame includes two upper, transversely oriented horizontal sleeves 38. The sleeves 38 are each axially slidable upon an elongated rod 40 disposed through the sleeve 38. The rod 40 is characterized by threaded extremities which are welded or otherwise secured to the upper extremities of a pair of vertically disposed, laterally spaced apart tubular side portions or legs 42.

A pair of internally threaded collars 44 are threaded upon the threaded extremities of the rod 40. Each includes a handle 46 to facilitate its rotation upon the rod 40. For example, rotation of the leftmost collar 44, as seen in FIG. 2, locates it farther to the left, and rotation of the other collar 44 also locates it farther to the left, moving the sleeves 38 with it.

Figure 5:
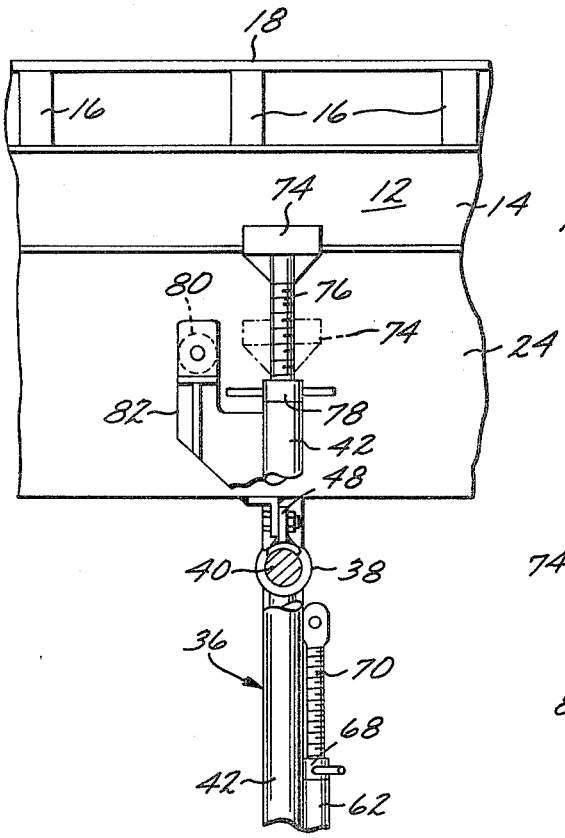
FIG. 5 is a side elevational view of the upper portion of the shoring frame illustrated in FIG. 4, with the frame in its vertical supporting position.
Figure 6:
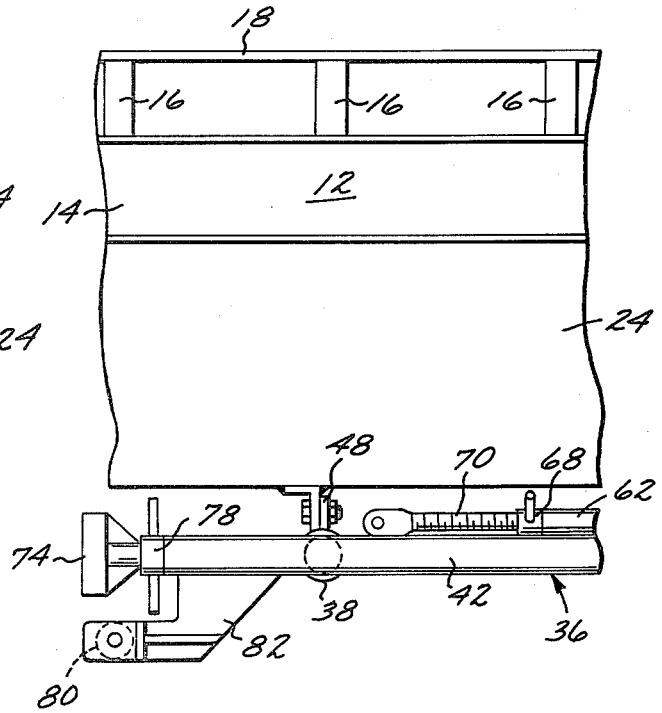
FIG. 6 is a view similar to FIG. 5 but illustrating the shoring frame in its retracted flying or rolling position.

The sleeves 38 are welded to tabs 48 which are rigidly bolted to the beam form bottom channel 34, as best seen in FIGS. 2, 5, and 6. Movement of the tabs 48 to the left with the sleeves 38 thereby moves the beam form 24 to the left.

Thus, the collars 44 constitute an adjustment means operative to laterally move the beam form 24 in either direction to locate a predetermined axis of the beam form (not shown) in alignment with the corresponding predetermined axis along which the beam 26 is to be poured, and also in alignment with the vertical centerlines of the columns defined by the column forms 22.

In addition to lateral adjustment of the beam form 24, the structure 10 is also adapted to adjust the vertical position of the beam form 24. This is accomplished by rotation in the proper direction of wing nuts 50 which are rotatably carried at the lower ends of the tubular legs 42. Each wing nut 50 is part of a typical screw jack arrangement. That is, a screw 52 having a larger area foot 54 at its lower end for engagement with the supporting surface is threaded through the associated sleeve 50, and passes into the hollow interior of leg 42. Rotation of the sleeves 50 in the proper direction raises or lowers the beam form 24 for proper alignment, as previously discussed.

The legs 42 are braced and reinforced by a horizontal transverse member 56 welded at its opposite ends to the mid portions of the legs. They are also braced by a pair of diagonal chords 58 welded between the ends of the member 56 and the legs 42, respectively. In addition, the whole shoring frame 36 is braced in the vertical, supporting position illustrated in FIG. 3 by means of a telescoping brace or jack 60. This brace can be used to move the beam form along its long axis to adjust it to the center of the columns.

Each jack 60 comprises an elongated tubular element 62 pivotally attached to a suitable bracket 64 secured to the mid portion of a transverse horizontal channel 66 welded at its opposite ends to the legs 42. The operation of the jack 60 is similar to that described for the legs 42, the upper end of the element 62 rotatably mounting an internally threaded sleeve 68 which threadably receives the lower end of a threaded screw 70. The upper end of the screw 70 is pivotally attached to a bracket 72 carried by one of the beam form bottom channels 34.

By proper rotation of the sleeve 68, the effective length of the jack 60 is reduced such that removal of the fastener or other connection securing the screw 70 to the bracket 72 enables the jack 60 to be folded upwardly, as seen in FIG. 5. This enables the associated shoring frame 36 to be pivoted upwardly to its horizontal "flying" or moving position, as seen in FIG. 6. During such pivotal movement, the threaded ends of the rod 40 rotate relative to the sleeve 38. Suitable latching means (not shown) are used to secure or latch the shoring frames 36 in their moving positions. During actual pouring, additional diagonal shoring braces may be used, as desired, to further brace the legs 42 in position.

In addition to its function of precisely locating the beam form 24 in alignment with the column forms 22, each shoring frame 36 also supports the slab form. For this purpose it includes vertically extensible and retractable slab form supports at the upper extremities of the legs 42. Each slab form support comprises an upwardly open, U-shaped head or channel 74 fixed to the upper end of a vertically oriented screw 76. The width and depth of the channel 74 is made to receive the lower portion of one of the side beams 14 of a slab form 12, as seen in FIG. 2.

The lower end of the screw 76 is threaded through an internally threaded sleeve 78 which is rotatably carried at the upper end of an associated frame leg 42. Rotation of the sleeves 78 raises or lowers the channel 74 to the proper height for supporting the slab form 12 at the correct elevation.

Figure 4:
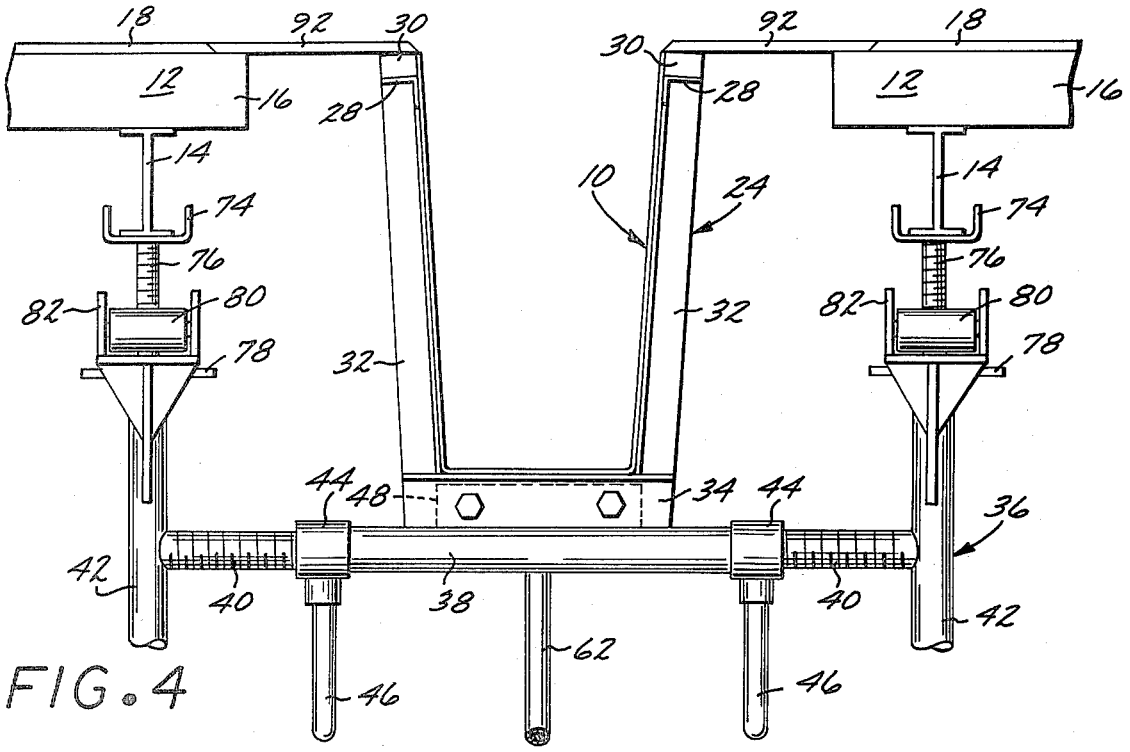
FIG. 4 is an end elevational view of the upper portion of the shoring frame illustrated in FIG. 2.

After the floor slab 20 has been poured and has cured, the slab form 12 must be lowered to strip it away from the cured slab 20. First, an auxiliary or center post shores supporting the slab form 12 are removed. Next, the sleeves 78 are rotated to lower the channels 74 until the base of the channels 74 is below the axis of rotation of a transversely oriented roller 80 rotatably carried by a bracket 82 secured to the upper extremity of the associated frame leg 42, as best seen in FIGS. 3 and 4. This brings the adjacent side beam 14 of the slab form 12 into engagement with the rollers 80, and the rollers 80 bear the weight of the slab form 12. The lowered slab form 12 can be rolled in a longitudinal direction away from the just-poured slab 20 and hoisted by suitable cables (not shown) attached to a crane or the like for relocating or "flying" the slab form 12 to the next pouring station for formation of another section or bay of floor slab 20. Alternatively, in parking garages where ramps connect each floor the relocating or stripping procedure is modified to the extent that the beam forms are held against the underside of the cured slab by a row of center post shores (not shown) during the folding of the support frames to their horizontal positions. Finally, the center post shores are knocked away to permit the slab form to fall or be lowered onto dollies for transportation to the next pouring station.

Prior to the beam pouring operation, and after the beam form 24 is aligned with the column forms 22, each form 22 is connected to an end of the form 24 by a U-shaped section 84. The section 84 is dimensioned to fit within one end of the beam form 24 and within the adjacent open end of the column form 22. It includes a plurality of outwardly extending threaded studs 86 which pass through suitable openings in a clamping strip 88 bearing against the end ones of the side and bottom channels 32 and 34. A plurality of fastener nuts 90, threaded onto the studs 86, secure the section 84 in position to bridge the space between the adjacent beam form 24 and column form 22.

In operation, a plurality of building columns are either poured, or the reinforcing rods for the columns are installed for pouring of the columns at the time of pouring of the beams and floor slabs. The beam forms 24 are located between the columns which they are to span, and the shoring frames 36 are pivoted into their vertical supporting positions. The jacks 60 are fitted into their bracing positions, and the sleeves 38 and 50 are rotated to locate the beam forms 24 at the proper height and in proper alignment with the centerlines of the associated column forms 22.

The U-head screw jacks or channels 74 are set to the approximate height desired, and the slab is lowered onto the channels 74 with a crane or forklifts. Next, the channels 74 are adjusted to the exact height desired. The rollers 80 are used only to roll forms out of the building to be flown by the crane. If desired, they can be constructed to be detachable where the forms are to be transported on dollies, rather than flown.

The bridging filler strips 92 are positioned upon the side edges of the slab form 12, forming continuations of the deck 18, and they are nailed to the nailers 30 of the beam forms 24. This provides a continuous surface between the beam forms 24 and the slab forms 12.

Concrete is then poured and allowed to cure to form the floor slab 20 and beams 14. Next, any auxiliary shoring posts are removed and the sleeves 78 are operated to lower the slab form 12 onto the rollers 80. This strips the form away from the freshly poured and cured slab 20. The slab form 12 is then rolled away and flown to the next pouring station for reuse or, as previously indicated, dolly transportation is employed in certain situations.

The sleeves 50 of the shoring frame legs 42 are rotated to lower the beam form 24 slightly, followed by rotation of the sleeves 78 so that the associated braces 60 for all of the shoring frames 36 except the ones at the end can be detached. All of the frames 36 except the end ones are pivoted to their horizontal, moving positions.

A suitable walking stack or forklift (not shown) is next located under the beam form 24 and raised to support the weight of the beam form 24 so that the end ones of the shoring frames 36 can be pivoted to their moving or flying positions. The forklift is then used to transport the beam form to the next pouring station, or to place the beam form on a suitable dolly (not shown) for transportation to the next pouring station.

Using the beam form and shoring structure 10 of the present invention thus enables rapid and accurate location and alignment of a beam form at the proper height and alignment with the centerlines of the building columns. In addition, the particular structure 10 enables these beam forms to be flown or otherwise transported to subsequent pouring stations for reuse.

Various modifications and changes may be made with regard to the foregoing detailed description without departing from the spirit of the invention or the scope of the following claims.

I claim:

1. Beam form and shoring structure comprising:

an elongated beam form having a beam form axis and adapted for use in forming a beam having a corresponding beam axis extending at a predetermined height between the centerlines of adjacent vertical columns of a building structure;

a plurality of shoring frames spaced apart along the length of said beam form and each including an upper portion pivotally carried by said beam form as an integral part thereof for movement of the associated said shoring frame between a vertical supporting position and a generally horizontal moving position, each shoring frame including, relative to said supporting position, a pair of vertically disposed, laterally spaced apart side portions having vertically adjustable jacks at their lower extremities, respectively, said jacks being operative to adjust the vertical position of said upper portion of said shoring frame to locate said beam form axis at said predetermined height, each said shoring frame further including adjusting means operative upon said upper portion for laterally moving said beam form to locate said beam form axis in alignment with said beam axis.

2. Beam form and shoring structure according to claim 1 wherein said side portions have vertically extensible and retractable slab form supports at their upper extremities, respectively, said slab form supports being extensible to underlie and support the sides of a pair of slab forms on opposite sides of said beam forms.

3. Beam form and shoring structure according to claim 1 wherein said upper portion of each of said shoring frames comprises a transverse elongated element having threaded extremities fixed, respectively, to said side portions, cylindrical sleeves secured to said beam form and laterally movable upon said elongated element, and means threaded upon said threaded extremities and operative to laterally move said sleeves for adjusting the lateral position of said beam form.

4. Beam form and shoring structure according to claim 1 and including brace means attachable between said beam form and one of said shoring frames for maintaining said shoring frame in said vertical supporting position, said brace means being detachable from said beam form for pivotal movement of said shoring frame to said horizontal moving position.

5. Beam form and shoring structure according to claim 2 wherein said side portions further include transversely oriented roller means at their upper extremities for supporting the associated side of one of said slab forms upon retraction of said slab form supports whereby said slab form may be rolled in a longitudinal direction upon said roller means.

6. Beam form and shoring structure comprising:

an elongated beam form for use in forming a beam of poured concrete at a predetermined height and in alignment with the centerlines of a pair of spaced apart vertical columns to be spanned by said beam;

connecting form means connectable between the ends of said beam form and a pair of column forms and operative to provide a continuous surface for containment of concrete freshly poured into said beam form and said column forms;

a plurality of shoring frames spaced apart along the length of said beam form and each including an upper portion, mounting means pivotally connecting said upper portion to said beam form as an integral part thereof for pivotal movement of said shoring frame between a vertical supporting position in contact with a supporting surface, and a generally horizontal moving position upwardly of said supporting surface; lateral adjusting means operative upon said upper portion for moving said upper portion laterally to adjust the lateral position of said beam form relative to said shoring frame whereby said beam form may be precisely aligned with the centerlines of said column forms subsequent location of said shoring frame in said supporting position; and vertical adjusting means operative to adjust the elevation of said beam form relative to said supporting surface in said supporting position of said shoring frame.

7. Beam form and shoring structure according to claim 6 wherein each said shoring frame further includes a slab form support which is vertically extensible to underlie and support a side of an adjacent slab form.

8. Beam form and shoring structure according to claim 6 wherein said upper portion comprises cylindrical sleeves, and said lateral adjusting means comprises a threaded rod supporting said sleeves and a threaded member rotatable upon said rod to engage and laterally move said sleeves.

9. Beam form and shoring structure according to claim 6 and including brace means attachable between said beam form and one of said shoring frames for maintaining said shoring frame in said vertical supporting position, said brace means being detachable from said beam form for pivotal movement of said shoring frame to said horizontal flying position.

10. Beam form and shoring structure according to claim 7 wherein each said shoring frame further includes transversely oriented roller means for supporting the associated side of one of said slab forms upon retraction of said slab form support whereby said slab form can be rolled in a longitudinal direction upon said roller means.

* * * * *